US006120198A

United States Patent [19]

Sawano et al.

[11] Patent Number: 6,120,198

[45] Date of Patent: Sep. 19, 2000

[54] PRINTING HEAD DRIVE APPARATUS AND METHOD FOR DRIVING PRINTING HEAD

[75] Inventors: Mitsuru Sawano; Osamu Shimizu, both of Shizuoka, Japan

[73] Assignee: Fuji Photo Film Co., Ltd., Kanagawa, Japan

[21] Appl. No.: 09/086,068

[22] Filed: May 29, 1998

[30] Foreign Application Priority Data

May 29, 1997 [JP] Japan ..... 9-140177

[51] Int. Cl.[7] ..... B41J 2/355

[52] U.S. Cl. ..... 400/120.05; 400/120.06

[58] Field of Search ..... 400/120.05, 124.02, 400/120.06; 347/180, 181, 182

[56] References Cited

U.S. PATENT DOCUMENTS

| | | | |
|---|---|---|---|
| 4,738,553 | 4/1988 | Uemura et al. | 400/120 |
| 5,359,352 | 10/1994 | Saita et al. | 347/62 |
| 5,873,661 | 2/1999 | Murata et al. | 400/124.04 |
| 5,873,663 | 2/1999 | Yokoi et al. | 400/279 |

*Primary Examiner*—John S. Hilten

*Attorney, Agent, or Firm*—Sughrue, Mion, Zinn, Macpeak & Seas, PLLC

[57] ABSTRACT

A printing head drive apparatus comprising: a plurality of printing elements which operate upon receipt of electric power; switching elements which are provided for the respective printing elements and which supply power to the corresponding printing elements; a control signal output section which outputs a control signal for actuating the respective switching elements in response to print data; and a timing control section which arbitrarily sets output timing of the control signal for each printing element.

16 Claims, 5 Drawing Sheets

| | 1 | 2 | 3 | 4 |
|---|---|---|---|---|
| K | 0ms | 3.5ms | 0ms | 3.5ms |
| C | 0ms | 0ms | 4.2ms | 4.2ms |
| M | 0ms | 5.25ms | 0ms | 5.25ms |
| Y | 0ms | 0ms | 7ms | 7ms |

| | 1 | 2 | 3 | 4 |
|---|---|---|---|---|
| K | 0ms | 3.5ms | 0ms | 3.5ms |
| C | 0ms | 0ms | 4.2ms | 4.2ms |
| M | 0ms | 5.25ms | 0ms | 5.25ms |
| Y | 0ms | 0ms | 7ms | 7ms |

PRINTING HEAD DRIVE APPARATUS AND METHOD FOR DRIVING PRINTING HEAD

BACKGROUND OF INVENTION

The present invention relates to a printing head drive apparatus for printing an image through use dots arranged in a staggered pattern by a thermal head or the like, and a method for driving a printing head.

For instance, in a thermal printer, an image is formed through use of a thermal head having heating elements placed in a line thereon. The thermal head forms an image on paper by controlling heating of each heating element corresponding to each dot. The outline of a printer equipped with a thermal head will be described by reference to FIG. 5.

A print data signal is input to the printer in a serial manner in accordance with a data transfer clock signal. The printer stores the thus input print data into a shift register 114. The instant when print data for one line are completely received, a latch circuit 115 latches the print data.

The latch circuit 115 actuates in unison switching elements 112 provided for respective heating elements 111, by outputting a strobe pulse signal in synchronism with a strobe synchronization signal. Consequently, the heating elements 111 whose switching elements 112 are brought into conduction receive power from a common electrode 125, thus becoming heated. By virtue of the heat, dots are formed on paper.

The conducting state (i.e., an ON/OFF state) of each switching element 112 changes in accordance with print data. A period of time during which the switching element remains in a conducting state also changes in accordance with print data for the dots (an area ratio of dots).

Recently, there has been employed a control technique whose principal purpose is to improve image quality and which involves forming pixel dots in a staggered pattern on paper by shifting timing at which a voltage is applied to the heating elements (i.e., heating timing). such a technique is described in, e.g., Japanese Patent Application Laid-open Hei. 7-312677.

Because of circuit configuration, heating is commenced in a synchronized manner for all the heating elements 111 of the existing printer (see FIG. 5) used for forming one line, and the timing at which a voltage is applied to the heating element cannot be uniquely controlled an each-heating-element basis (nor on a group-by-group basis, provided that the heating elements for one line are divided into a plurality of groups). Accordingly, to commence application of a voltage to a certain group of heating elements, application of voltage to another group of heating elements must be completed.

In order to divide the heating elements for one line into a plurality of groups and to apply a voltage to the groups at different timing, a time period capable of being assigned to one group (i.e., the length of time during which a voltage can be applied to the group) must be reduced to a time period shorter than that used for a printer which does not apply a voltage to the heating element at shifted timing.

Further, because of circuit configuration, print data must be input to the printer immediately before application of a voltage to the heating elements. Since solely the timing of heating of an element cannot be shifted without reference to transfer of print data, there arises dead time during which print data are transferred. Accordingly, in effect, the length of time during which a voltage can be applied (i.e., the width of a strobe pulse) is reduced to a greater extent.

FIG. 6 shows strobe pulse signals for black (K) and cyan (C) in a case where the timing of heating is controlled by dividing the heating elements into an odd-numbered group and an even-numbered group. As shown in FIG. 6, the length of time capable of being assigned to each group is reduced to a value (e.g., 3.5 ms in the example) less than one-half that used for the known printer (i.e., a printer in which all the heating elements used for forming one line are heated in a synchronized manner).

Such being the case, if dots are output at an area ratio of 100% (i.e., what is called a solidly shaded image is formed), clearance is created among the dots, resulting in a failure to reach an area ratio of 100%. For this reason, in a case where dots having a large area ratio are formed, the voltage applied to the heating elements by way of the common electrode is increased to a value greater than an ordinary voltage to thereby supply greater power (or energy) to the heating elements within a shorter period of time, thus compensating for creation of clearance.

However, an increase in voltage results in an excessive increase in the peak temperature of the head, and anomalies stemming from overheat sometimes arise in printing material.

SUMMARY OF THE INVENTION

An object of the present invention is to provide a printing head drive apparatus capable of reliably printing tone in accordance with the tone in the area (particularly, dots having an area ratio of 100%) without application of an excessive voltage, and a method for driving the printing head.

A printing head drive apparatus according to the present invention, comprises: a plurality of printing elements which operate upon receipt of electric power; switching elements which are provided for the respective printing elements and which supply power to the corresponding printing elements; a control signal output section which outputs a control signal (a strobe signal) for actuating the respective switching elements in response to print data; and a timing control section which arbitrarily sets output timing of the control signal for each printing element.

The printing elements may include heating elements which are heated upon receipt of the electric power.

Further, the timing control section is capable of arbitrarily setting the output timing of the control signal for each of groups into which the printing elements are classified according to the sequence in which the elements are placed.

Still further, the timing control section is capable of arbitrarily setting the output timing of the control signal according to an external signal.

A thermal head drive apparatus according to the present invention, comprises: a plurality of thermal elements which are heated upon receipt of electric power; switching elements which are provided for the respective heating elements and which supply power to the corresponding heating elements; a control signal output section which outputs a control signal for actuating the respective switching elements in response to print data; and a timing control section which arbitrarily sets output timing of the control signal for each heating element.

A method, according to the present invention, for driving a printing head which has a plurality of printing elements which operate upon receipt of electric power, the method comprising the steps of: generating a control signal for driving switching elements to control electric power supply to the printing elements in response to print data; and setting arbitrarily output timing of the control signal for each printing element.

Further, in the setting step, the output timing of the control signal is arbitrarily set for each of groups into which the printing elements are classified in accordance with a sequence in which they are placed.

Still further, the setting step, the output timing of the control signal is set according to an external signal.

DETAILED DESCRIPTION OF PREFERRED EMBODIMENTS

With reference the accompanying drawings, a preferred embodiment of the present invention will be described hereinbelow.

A printing head drive apparatus according to the present embodiment is designed so as to be able to set the start timing of heating for each of groups into which heating elements of the printing head, for instance a thermal head, are divided. Particularly, according to the present embodiment, independent control of start timing of heating is effected without an accompanying reduction in a time during which a voltage can be applied to each of the heating elements (i.e., the maximum width of a strobe pulse signal), by adoption of a drive apparatus capable of shifting the actuation timing of a switching element of each heating element.

Figure 1:
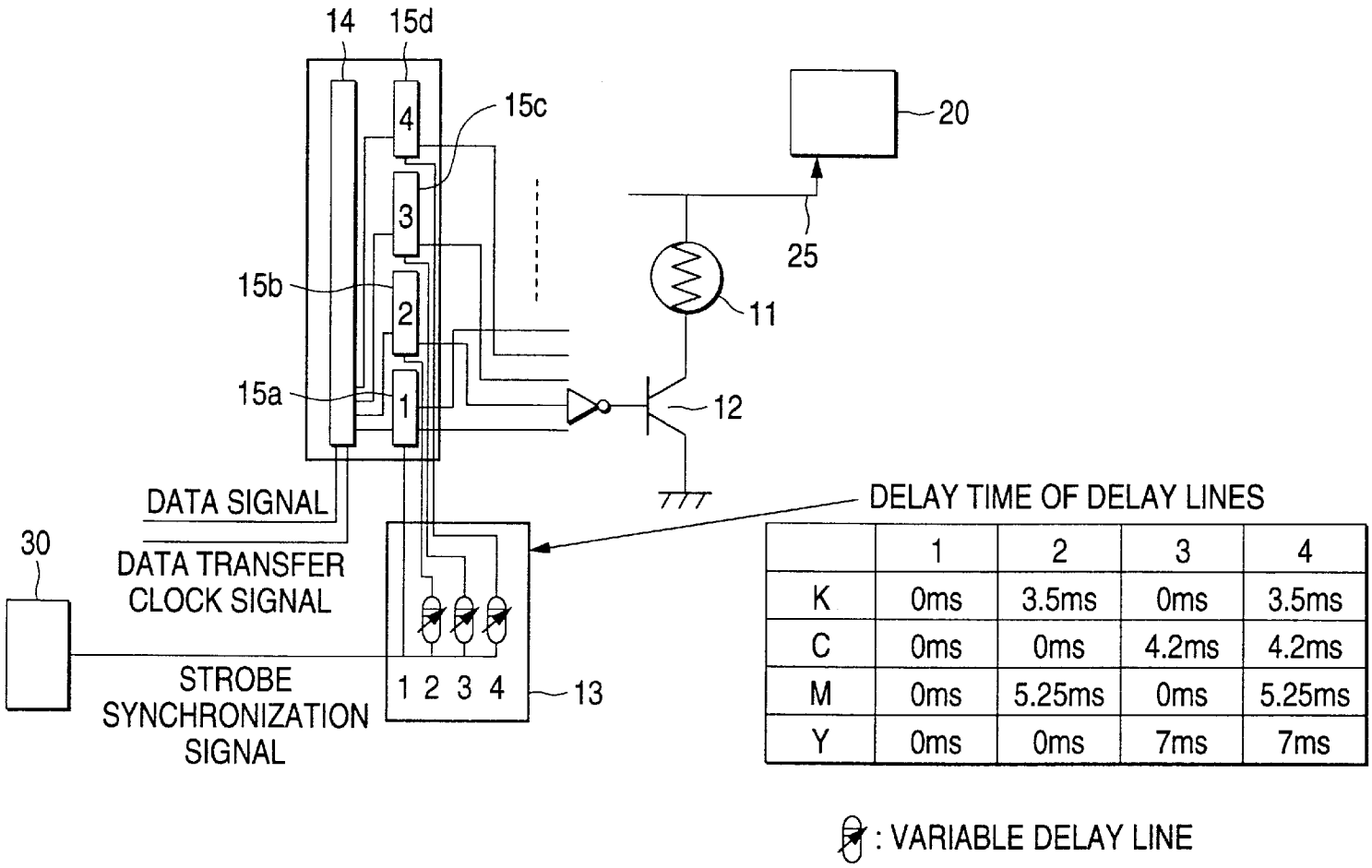
FIG. 1 is a block diagram and a table showing a thermal head drive apparatus according to a first embodiment of the present invention.

FIG. 1 shows the printing head drive apparatus according to the present embodiment. In this embodiment, the thermal head is provided as a printing head. As shown in FIG. 1, the thermal head drive apparatus comprises heating elements 11, switching elements 12, a shift register circuit 14 having a control signal output section, latch circuits 15*a*, 15*b*, 15*c*, and 15*d*, a timing control circuit 13 which controls actuation timing of the switching element 12, a power supply circuit 20, and a control circuit 30, which produces a strobe synchronization signal. Further, the thermal head drive apparatus includes wiring for connecting the above-described elements together (e.g., a common electrode 25 which connects a power circuit 20 to the heating elements 11).

The heating elements 11 generate heat required to form dots on paper, from the power supplied from the power supply circuit 20. In the present embodiment, the heating elements 11 are placed in a line and are divided into four groups, thus enabling the start timing of heating to be controlled for each group by means of individual sections, which will be described later.

The heating elements 11 are classified into groups according to the sequence in which they are placed (or according to the system of residues of four of their positions in the line in the present embodiment). More specifically, the heating elements are classified into a group of heating elements 1, 5, . . . (4N-3) (hereinafter referred to as a "first group"), a group of heating elements 2, 6, . . . , (4N-2) (hereinafter referred to as a "second group"), a group of heating elements 3, 7, . . . , (4N-1) (hereinafter referred to as a "third group"), and a group of heating elements 4, 8, . . . , (4N) (hereinafter referred to as a "fourth group"). In the drawing, the start timing of heating for each of the first through fourth groups of colors (K, C, M, Y) is provided in the form of a table.

The heating elements 11 are placed in the widthwise direction of printing paper (or the primary scanning direction). A thermal head is positioned in such a way that the line of the heating elements 11 becomes orthogonal to the direction in which paper is fed (or the secondary scanning direction). The power is supplied to the heating elements from the power supply circuit 20 by way of the common electrode 25.

The switching elements 12 act to selectively set the power supply to the heating elements 11 (or application of a voltage to the heating elements) to a conducting/nonconducting state and are provided for the respective heating elements 11. The conducting state (or ON/OFF state) of each switching element 12 is controlled by a corresponding latch circuit 15.

In the present embodiment, when the strobe pulse signal output from the latch circuit 15 is low, the switching element is brought into conduction (or a voltage is applied to the switching element). In contrast, when the strobe signal is high, the switching element is brought out of conduction. Further, the time during which each switching element is in conduction (or the width of the strobe pulse signal) is changed according to the input print data so as to correspond to the switching element 12 (i.e., the area ratio of dots to be formed by the heating element 11).

The timing control circuit 13 produces four types of strobe synchronization signals, which differ in timing from one another, by shifting the strobe synchronization signal received from the control circuit 30 (hereinafter referred to as an "original strobe synchronization signal") by merely a given amount. The timing control circuit 13 has a variable delay line capable of being delayed every line.

As shown in FIG. 1, with regard to black (K) according to the present embodiment, the first and third strobe synchronization signals have the same timing as that of the original strobe synchronization signal (i.e., delay time=0). In contrast, the second and fourth strobe signals are delayed from the original strobe synchronization signal by 3.5 ms. Likewise, with regard to the other colors (i.e., cyan (C), magenta (M), and yellow (Y)), the amount of shift in the strobe synchronization signals is set. For cyan (C) and yellow (Y) colors, the first and second strobe synchronization signals have the same timing, and the third and fourth strobe signals have the same timing. In short, the timing of voltage application is set so as to change every two heating elements. For magenta (M) color, the timing of voltage application is set so as to become alternate between two values (i.e., odd-numbered strobe synchronization signals have one timing and even-numbered strobe synchronization signals have another timing), as in the case of black (K) color.

The shift register circuit 14 stores print data for one line input in a serial manner in accordance with a data transfer clock signal.

The latch circuits 15*a*, 15*b*, 15*c*, and 15*d* latch the print data stored in the shift register circuit 14. The latch circuits

15*a,* 15*b,* 15*c,* and 15*d* control the conducting state (or ON/OFF state) of the switching element 12 by outputting a strobe pulse signal in accordance with the timing of the strobe synchronization signal received from the timing control circuit 13.

As mentioned previously, when the strobe pulse signal from the latch circuit 15 is low, the switching element 12 is brought into conduction. In contrast, when the strobe pulse signal is high, the corresponding switching element 12 is brought out of conduction. In such a case, the timing at which the switching element 12 is brought into conduction (i.e., the start timing of heating) changes according to the strobe pulse signal input to each of the latch circuits 15*a,* 15*b,* 15*c,* and 15*d.* The duration of the strobe pulse signal (i.e., a pulse width) also changes depending on the input print data so as to correspond to the respective hating element 11 and the respective switching element 12.

The latch circuit 15*a* corresponds to the heating element 11 and the switching element 12 of the first group. The latch circuit 15*b* corresponds to the heating element 11 and the switching element 12 of the second group. The latch circuit 15*c* corresponds to the heating element 11 and the switching element 12 of the third group. The latch circuit 15*d* corresponds to the heating element 11 and the switching element 12 of the fourth group.

The power supply circuit 20 supplies power to each of the heating elements 11 by way of the common electrode 25.

The control circuit 30 produces the original strobe synchronization signal, controlling the overall printer operations. More specifically, the control circuit comprises memory which stores control data or programs, and a processor which executes control programs.

The delay circuit comprises the control circuit 30, the timing control circuit 13, and the latch circuit 15*a,* 15*b,* 15*c,* and 15*d.*

A method for driving the printing head of an embodiment according to the present invention will now be described by reference to FIG. 2.

Figure 2:
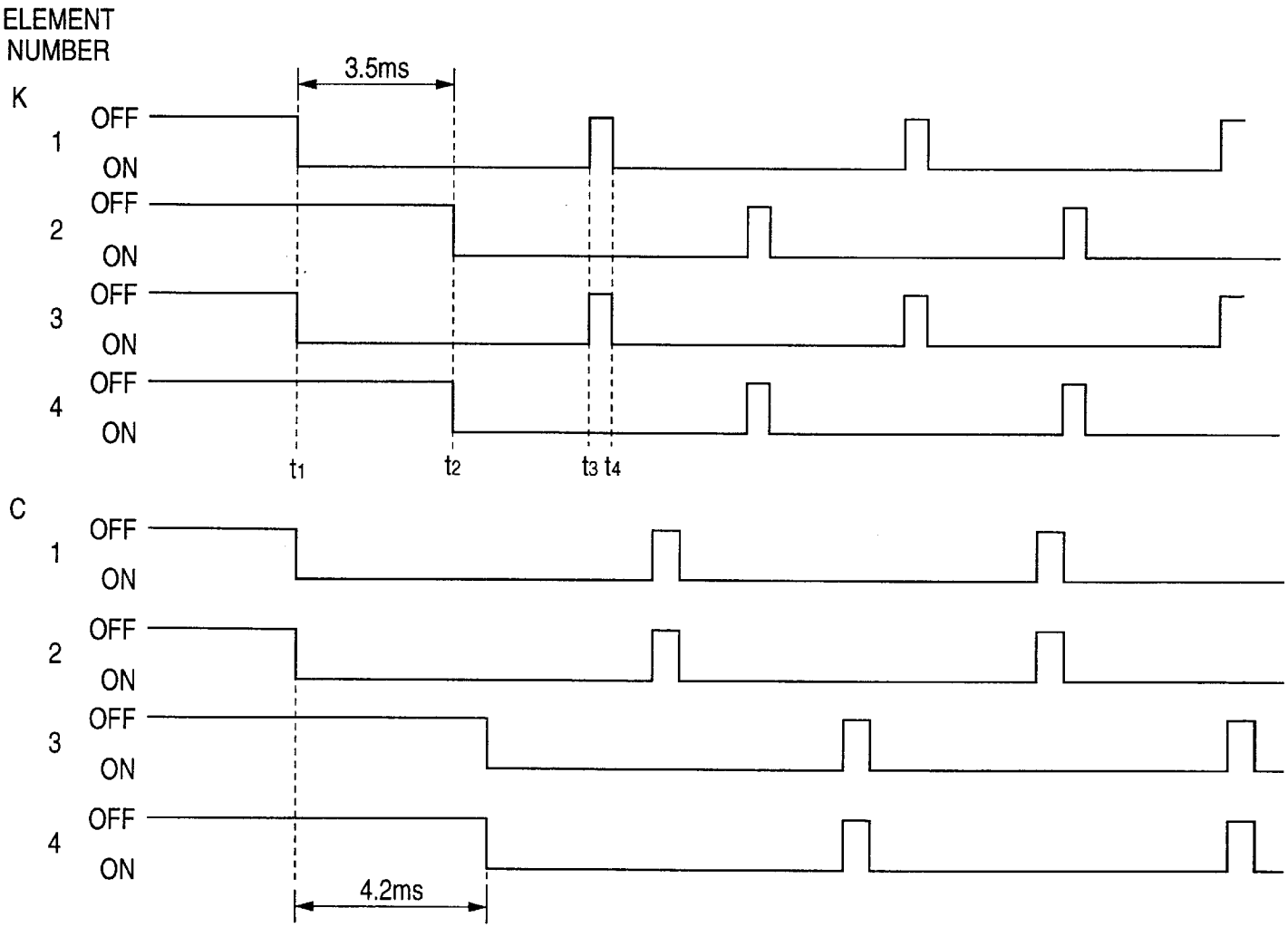
FIG. 2 is a timing chart showing strobe pulse signals when the head drive apparatus is printing.

FIG. 2 shows a timing chart of strobe pulse signals output to switching elements 12(1), 12(2), 12(3), and 12(4) divided into four groups.

The shift register circuit 14 stores print data for one line, and the latch circuit 15 latches the thus-stored print data. In accordance with the strobe synchronization signal controlled by the timing control circuit 13, the print data are supplied to the switching element 12 in the form of a strobe pulse signal.

As shown in FIG. 2, first, the control circuit 13 outputs the first and third strobe signals. In response to these signals, the latch circuits 15*a* and 15*c* output strobe pulse signals at time (t1). These strobe pulse signals bring into conduction the switching elements 12(1), 12(3), 12(5), 12(7), . . . 12(4N-3), 12(4N-1) of the first and third groups. As a result, heating of the heating elements 11(1), 11(3), 11(5), 11(7), . . . , 11(4N-3), 11(4N-1) corresponding to the switching elements is commenced.

After a given period of time has elapsed after commencement of output of the first and third strobe synchronization signals, the timing control circuit 13 outputs the second and fourth strobe synchronization signals. In response to the output of the synchronization signals, the latch circuits 15*b* and 15*d* outputs strobe pulse signals at timing (t2). The strobe pulse signals bring into conduction the switching elements 12(2), 12(4), 12(6), 12(8), . . . , 12(4N-2), 12(4N) of the second and fourth groups. Heating of the heating elements 11(2), 11(4), 11(6), 11(8), . . . , 11(4N-2), 11(4N) corresponding to the switching elements is commenced.

Even after application of a voltage to the heating elements 11 of the second and fourth groups has been commenced, the voltage is continually applied to the heating elements 11(1), 11(3), 11(5), 11(7), . . . , 11(4N-3), 11(4N-1), as is. When the strobe pulse signal becomes off at timing (t3) after elapse of a given period of time, the switching elements 12(1), 12(3), 12(5), 12(7), . . . , 12(4N-3), 12(4N-1) are correspondingly brought out of conduction, completing application of a voltage to the heating elements 11 of the first and third groups.

In FIG. 2, for brevity, the strobe pulse width is set to the maximum width corresponding to the dots having an area ratio of 100%. As a matter of course, the timing at which the strobe pulse signal is completed (i.e., the width of the strobe pulse signal) changes according to the input print data so as to correspond to the respective heating element 11.

Subsequently, the shift register circuit 14 waits for another new print data set, and voltage application is repeated after timing (t4) in a similar manner described previously.

Figure 3:
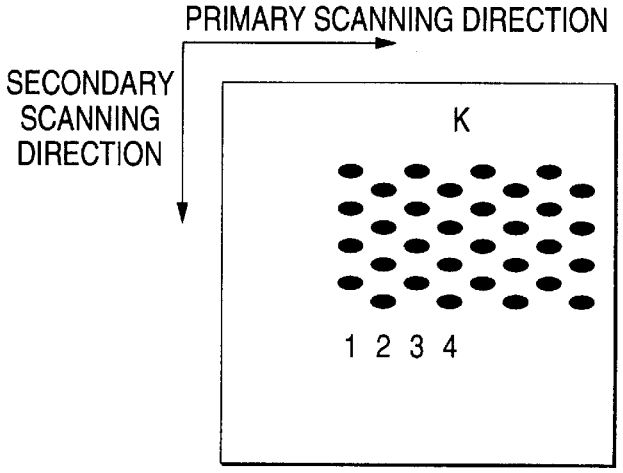
FIGS. 3(*a*), 3(*b*), 3(*c*), and 3(*d*) are schematic representations showing an array of dots.
Figure 3:
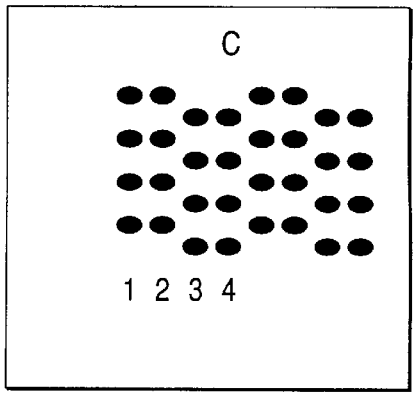
Figure 3:
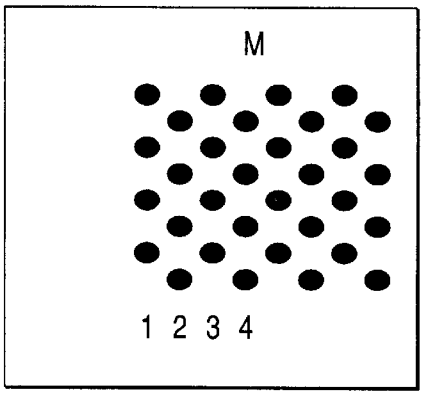
Figure 3:
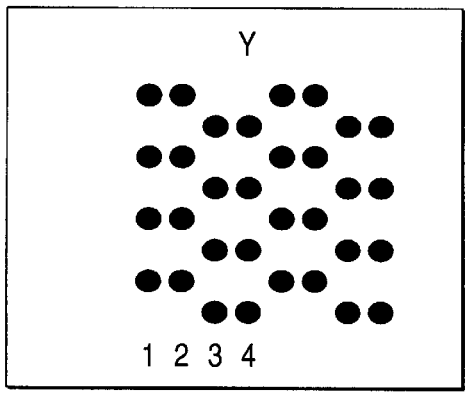

FIG. 3(*a*) shows a dot pattern of black (K) thus formed. Numerals (1 though 4) provided in the drawing represent element numbers corresponding to respective dots. In the drawing, the primary scanning direction designates the direction in which the heating elements are positioned, and the secondary scanning direction designates the direction in which paper is fed. FIGS. 3(*b*), 3(*c*), and 3(*d*) show dot patterns of the other colors (C, M, Y) when the start timing of heating of each group is controlled in accordance with the combinations provided in FIG. 1.

Figure 6:
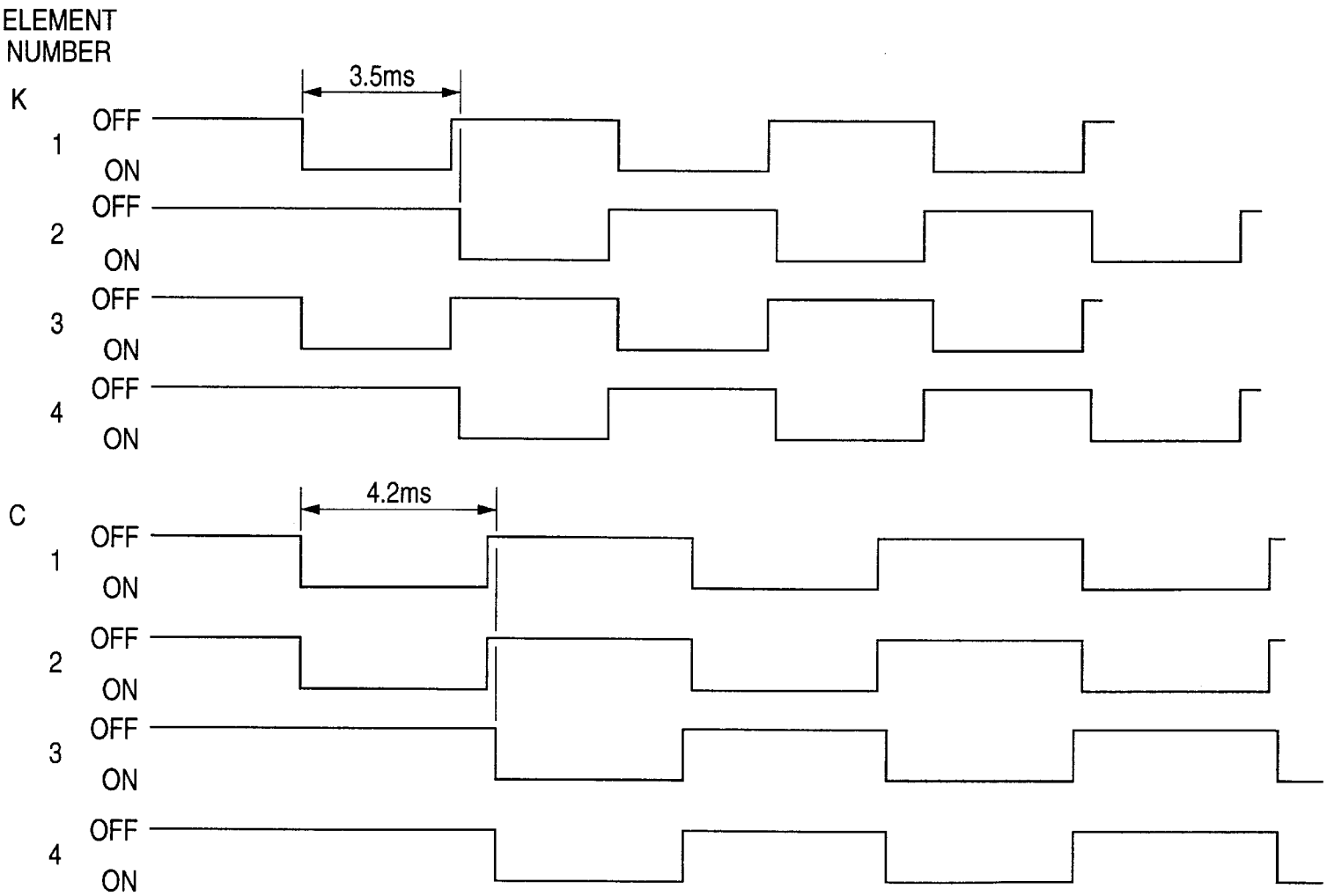
FIG. 6 is a timing chart showing strobe pulse signals used in the conventional drive apparatus.

According to the foregoing embodiment, as is evident from a comparison between the present invention shown in FIG. 2 and the conventional one shown in FIG. 6, the strobe pulse width (i.e., the time during which a voltage is applied to the switching element) is not reduced even when the start timing of heating of the heating element 11 is controlled on a per-group basis. Accordingly, even when dots having a high area ratio are formed it is not necessary to increase the voltage applied to the heating elements 11. Therefore, anomalies are prevented which would otherwise arise in printing material as a result of overheating of a head, hence increasing the life of a head.

Figure 4:
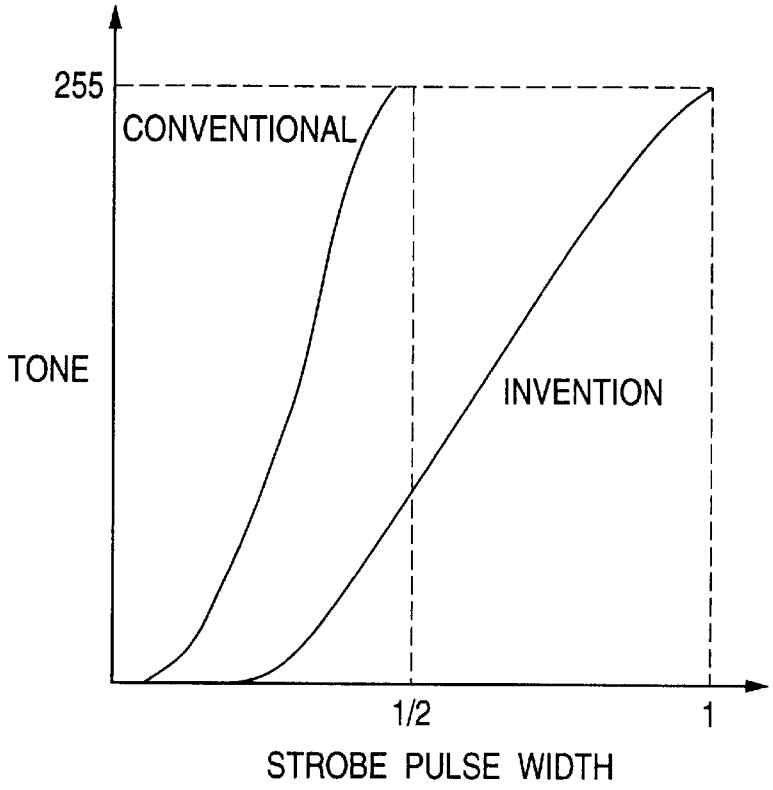
FIG. 4 is a graph showing the relationship between tone and the width of a strobe pulse signal.
Figure 5:
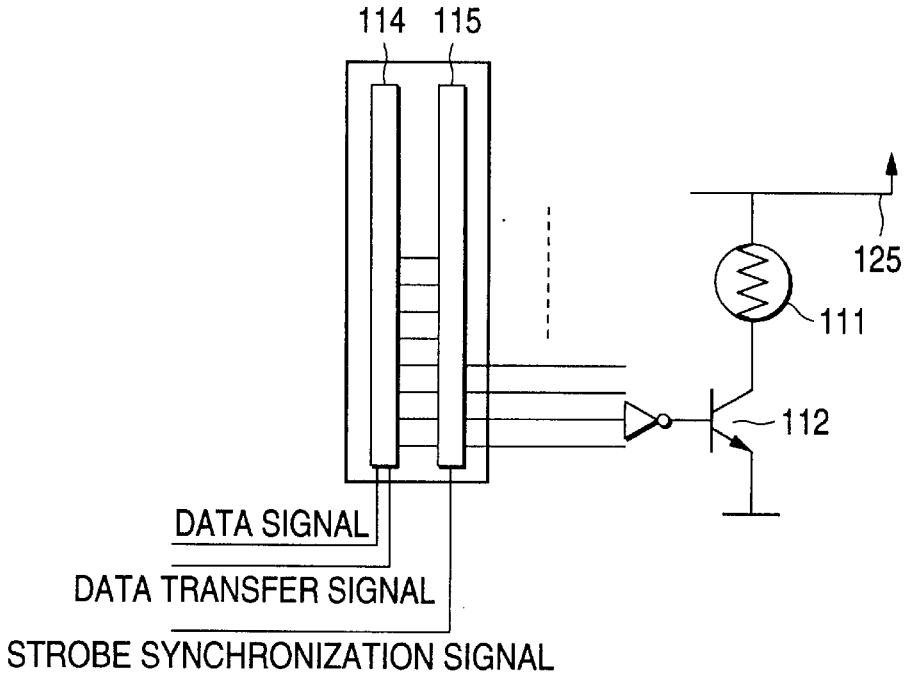
FIG. 5 is a block diagram showing a conventional thermal head drive apparatus.

Since dots do not become thick in the primary scanning direction, the gradient of a concentration-to-strobe curve (or γ characteristic) becomes gentle (see FIG. 4). This in turn contributes to easy tone control, and various types of inconsistencies stemming from resistance or head temperature are reduced in severity and become easy to correct.

Although the foregoing embodiment has been described with reference to an area-tone printer, the present invention can also be applied to a concentration-tone printer such as a sublimation-type printer. In this case, inconsistency, such as a sticking phenomenon, arising in the direction in which paper is fed can be made less visible.

Although in the previous embodiment the heating elements are divided into four groups according to the sequence in which they are positioned, the number of groups or the way in which the heating elements are divided is not limited to that described for the previous embodiment.

EXAMPLE

The following are printing results which were produced by a printer equipped with a thermal head based on the present invention under the following conditions.

1. Printing Conditions (1) Specifications Concerning Thermal Head

Heating Element Pitch: 300 dpi

Heating Element Size: 70 μm in the primary scanning direction, and 80 μm in the secondary scanning direction Number of Heating Elements: 3,648

Resistance: Mean Resistance of 3,550 Ω

(2) Printing Material (Ribbon: Proof Ribbon J for First Proof of Digital Color Proof (manufactured by Fuji Photo Film Co., Ltd.)

(Receiver: Receiver Sheet for First Proof of Digital Color Proof (manufactured by Fuji Photo Film Co., Ltd.)

(3) Printing Conditions

Line Speed: 7 msec/line (on the basis of 300-dpi resolution)

Array of Dots: See FIGS. 3(*a*) to 3(*d*)

Dot Pitch in the Secondary Scanning Direction

K: 300 dpi, C: 250 dpi

M: 200 dpi, Y: 150 dpi

Dot Pitch in the Primary Scanning Direction

K: 150 dpi, C: 75 dpi

M: 150 dpi, Y: 75 dpi

Applied Voltage: 14.6 V

2. Conclusion

The print head controlled by the conventional method requires application of a voltage of 16.3V in order to prevent clearance from being created among dots in a solidly shaded yellow (Y) image. In contrast, according to the present invention, it was acknowledged that there was prevented creation of clearance among the dots at an applied voltage of 14.6 V. Microscopic observation of the dots in the solidly shaded yellow (Y) image formed by the existing method clearly shows that a reduction in concentration, stemming from deformation at the center of the dots, and that according to the present invention there is no such reduction in concentration, but concentration is uniform.

In the above described embodiment, the printing head drive apparatus drives the thermal head, for printing an image though use of dots arranged in a staggered pattern. Furthermore, the present invention may apply to other types of a printing head having plural printing elements, and achieve similar advantages.

For instance, the present invention may apply to an LED (Light Emitting Diode) head. The LED head has plural LEDs aligned thereon, and exposes the light on a medium in response to the driving signals of the respective LEDs. Since a driving circuit of the LEDs can use a switching circuit such as transistors, the delay circuits being similar to the embodiment described above may connect with respective transistors. Therefore, in this case, the same advantages are achieved.

Furthermore, the present invention may apply to a liquid crystal line head. The liquid crystal line head has plural elements, which are individually driven, arranged on a board. The liquid crystal line head is put between a linear light source and a medium so that the light in response to the driving signals of the respective elements is exposed on the medium. A driving circuit, for instance in the TFT system, has transistors, each connecting to the respective element. Accordingly, the delay circuits being similar to the embodiment described above may be provided with the respective transistors so that the same advantages are achieved.

Moreover, the similar delay circuits can be applied to a head in which plural printing elements are individually driven, such as an EL (electro-luminescence) head, a PLZT (lead lanthanum zirconate titanate) head, a LD (laser diode) array head, an electro thermo-recording head, and an electrostatic printing head.

According to the present invention, the printing tone can be reliably expressed in accordance with an area ratio of dots without an accompanying increase in a voltage applied to the printing elements. Further, since the peak temperature of a head using the heating elements can be reduced to a lower temperature, soil is less apt to stick to the head.

The load exerted on an apparatus (particularly a head) is reduced, and hence an apparatus can be expected to have a life longer than that of an existing apparatus. Conversely, if the apparatus is required to have only substantially the same life as that of the existing apparatus, the cost of the apparatus can be reduced.

Since dots do not become thick in the primary scanning direction (or the direction in which elements are placed), the gradient of a concentration-to-strobe curve (or γ characteristic) becomes gentle. This in turn contributes to easy tone control, and various types of inconsistencies stemming from resistance or head temperature are reduced in severity and become easy to correct.

What is claimed is:

1. A printing head drive apparatus comprising:

a plurality of printing elements, which operate upon receipt of electric power;

switching elements which are provided for the respective printing elements and which supply power to the corresponding printing elements;

a control signal output section which outputs a control signals for actuating the respective switching elements in response to print data; and a timing control section which arbitrarily offsets an output timing of the control signal for each printing element with respect to an output timing of the control signal for others of the printing elements, wherein the control signal is output to at least one of the printing elements, wherein a first operational period of the at least one of the printing elements and a second operational period of at least one other of the printing elements are offset with respect to each other yet partially coincide with each other.

2. The printing head drive apparatus according to claim 1, wherein the printing elements include heating elements which are heated upon receipt of the electric power.

3. The printing head drive apparatus according to claim 1, wherein the timing control section is capable of arbitrarily offsetting the output timing of the control signal for each of a plurality of groups into which the printing elements are classified in accordance with a sequence in which the printing elements are placed.

4. The printing head drive apparatus according to claim 3, wherein the timing control section is capable of arbitrarily offsetting the output timing of the control signal according to an external signal.

5. The printing head drive apparatus according to claim 1, wherein at least one offset control signal, based on the control signal, is output in an arbitrarily delayed manner to the at least one other of the printing elements.

6. The printing head drive apparatus according to claim 5, wherein the arbitrarily delayed manner of at least one of colors to be recorded is different from arbitrarily delayed manners of other colors to be recorded.

7. A thermal head drive apparatus comprising:

a plurality of heating elements which are heated upon receipt of electric power;

switching elements which are provided for the respective heating elements and which supply power to the respective heating elements;

a control signal output section which outputs a control signal for actuating the respective switching elements in response to print data; and a timing control section which arbitrarily offsets an output timing of the control signal for each heating element with respect to an output timing of the control signal for others of the heating elements, wherein the control signal is output of at least one of the heating elements, wherein a first operational period of the at least one of the heating elements and a second operational period of at least one other of the heating elements are offset with respect to each other yet partially coincide with each other.

8. The thermal head drive apparatus according to claim 7, wherein the timing control section generates strobe synchronization signals, which differ in timing from one another, by shifting the control signals received from the control signal output section by merely a given amount.

9. The thermal head drive apparatus according to claim 8, wherein the timing control section includes a variable delay line capable of being delayed every line.

10. The thermal head drive apparatus according to claim 7, wherein at least one offset control signal, based on the control signal, is output in an arbitrarily delayed manner to the at least one other of the printing elements.

11. The thermal head drive apparatus according to claim 10, wherein the arbitrarily delayed manner of at least one of colors to be recorded is different from arbitrarily delayed manners of other colors to be recorded.

12. A method for driving a printing head which has a plurality of printing elements, which operate upon receipt of electric power, the method comprising the steps of:

generating a control signal for driving switching elements to control electric power supply to the printing elements in response to print data;

arbitrarily offsetting an output timing of the control signal for each printing element with respect to an output timing of the control signal for others of the printing elements; and outputting the control signal to at least one of the printing elements;

wherein a first operational period of the at least one of the printing elements and a second operational period of at least one other of the printing elements are offset with respect to each other yet partially coincide with each other.

13. The method for driving a printing head according to claim 12, wherein, in the setting step, the output timing of the control signal is arbitrarily offset for each of a plurality of groups into which the printing elements are classified in accordance with a sequence in which the printing elements are placed.

14. The method for driving a printing head according to claim 13, wherein, in the setting step, the output timing of the control signal is offset according to an external signal.

15. The method for driving a printing head according to claim 12, further comprising the step of:

outputting at least one offset control signal, based on the control signal, in an arbitrarily delayed manner to the at least one other of the printing elements.

16. The thermal head drive apparatus according to claim 15, wherein the arbitrarily delayed manner of at least one of colors to be recorded is different from arbitrarily delayed manners of other colors to be recorded.

* * * * *